US005810255A

United States Patent [19]

Itoh et al.

[11] Patent Number: 5,810,255

[45] Date of Patent: Sep. 22, 1998

[54] CLAMPING DEVICE FOR A PIESOELECTRIC ACTUATOR OF A FUEL INJECTION VALVE FOR INTERNAL COMBUSTION ENGINES

[75] Inventors: Katsuoki Itoh, Leonberg; Rudolf Heinz, Renningen; Winfried Moser, Ludwigsburg, all of Germany

[73] Assignee: Robert Bosch GmbH, Stuttgart, Germany

[21] Appl. No.: 701,623

[22] Filed: Aug. 22, 1996

[30] Foreign Application Priority Data

Aug. 29, 1995 [DE] Germany ..... 195 31 652.5

[51] Int. Cl.[6] ..... B05B 1/08

[52] U.S. Cl. ..... 239/102.2; 239/533.2; 239/533.3; 239/584; 251/129.06; 310/327

[58] Field of Search ..... 239/102.2, 533.2, 239/533.3, 533.8, 584; 251/129.06; 310/326, 327

[56] References Cited

U.S. PATENT DOCUMENTS

| | | | |
|---|---|---|---|
| 4,441,101 | 4/1984 | Robar | 340/606 |
| 4,494,727 | 1/1985 | Babitzka et al. | 251/64 |
| 4,531,676 | 7/1985 | Seifert et al. | 239/453 |
| 4,575,008 | 3/1986 | Kaczynski | 239/533.3 |
| 4,584,980 | 4/1986 | Weiger et al. | 123/458 |
| 4,605,171 | 8/1986 | Trachte et al. | 239/453 |
| 4,725,002 | 2/1988 | Trachte | 239/102.2 |
| 4,750,706 | 6/1988 | Schlagmuller | 251/129.06 |
| 4,783,003 | 11/1988 | Hirabayashi et al. | 239/102.2 |
| 4,974,780 | 12/1990 | Nakamura et al. | 239/102.2 |
| 5,033,679 | 7/1991 | Golev et al. | 239/533.3 |
| 5,169,067 | 12/1992 | Matsusaka et al. | 239/102.2 |
| 5,330,100 | 7/1994 | Malinowski | 239/102.2 |
| 5,593,134 | 1/1997 | Steber et al. | 251/129.17 |

FOREIGN PATENT DOCUMENTS

| | | |
|---|---|---|
| 3608494 | 9/1987 | Germany . |
| 2128678 | 5/1984 | United Kingdom . |
| 2165308 | 4/1986 | United Kingdom . |

*Primary Examiner*—Andres Kashnikow
*Assistant Examiner*—Lisa Ann Douglas
*Attorney, Agent, or Firm*—Edwin E. Greigg; Ronald E. Greigg

[57] ABSTRACT

A fuel injection for internal combustion engines, having a valve member which is guided so that it moves axially in a valve body and uses a sealing face provided on a combustion chamber end to open and close an injection opening on the valve body. A piezoelectric actuator includes a piezoelectric stack, which changes in length with the action of a control voltage, is coupled to the combustion chamber end of the valve member to actuate the valve member. In order to prevent an interference with a precise adjustment motion of the valve member of an unwanted length change in the piezoelectric stack, a clamping device is provided which fixes the end of the piezoelectric stack remote from the valve member in its axial position during the injection phase of the fuel injection valve, and permits an axial compensation for play at the piezoelectric stack during an injection pause.

8 Claims, 2 Drawing Sheets

CLAMPING DEVICE FOR A PIESOELECTRIC ACTUATOR OF A FUEL INJECTION VALVE FOR INTERNAL COMBUSTION ENGINES

BACKGROUND OF THE INVENTION

The invention is based on a fuel injection valve for internal combustion engines. DE-OS 35 33 085 discloses a fuel injection valve of this kind in which the valve member, which opens and closes an injection cross section, is actuated directly by a piezoelectric actuator whose axial length changes through the application of an operating voltage. As a result of this direct valve member actuation, which can be executed only by means of very rapidly functioning actuators, it is possible to shape the opening stroke movement of the valve member and with it, the course of injection of the fuel to be injected, independent of the injection pressure. This shaping of the course of injection permits an optimal adaptation of the injection quantity and injection time to the respective engine requirements, which depend on the operating parameters, and thus makes possible an optimal combustion with the lowest possible emission of pollutants.

However, with the use of piezoelectric actuators, so-called piezoelectric stacks, the disadvantage arises that their axial extension also changes rapidly as a result of temperature fluctuations so that the exact initial position required for a precise control of the valve member stroke motion changes. Depending upon the embodiment of the injection valve, these imprecise initial positions of the free end of the piezoelectric stack, which also occur because of manufacture tolerances or abrasion, can result in an impairment of the sealing action or an insufficient opening stroke motion of the valve member, depending upon the embodiment of the injection valve.

In order to compensate for these unwanted length changes in the piezoelectric stack, the known fuel injection valve has a hydraulic damping chamber into which a damping piston disposed on the piezoelectric stack protrudes. This damping chamber is intended to fix the piezoelectric stack with its one end stationary when it is electrically excited, but is intended to permit a slow change in length.

This kind of fixing of the end of the piezoelectric stack remote from the valve member by means of a damping chamber, however, has the disadvantage that the position fixing during the injection phase does not take place precisely and rapidly enough since the holding pressure in the damping chamber always adjusts only after a certain delay and after a small stroke path of the damping piston is carried out.

In addition, the device disclosed in DE-OS 35 33 085 for fixing the piezoelectric stack limits the outwardly opening design in injection valves.

OBJECT AND SUMMARY OF THE INVENTION

The fuel injection valve according to the invention for internal combustion engines has the advantage over the prior art that at the beginning of the injection phase, the piezoelectric stack actuating the valve member, on its end remote from the valve member, is very rapidly fixed in position in relation to the valve body so that an impairment of the precision of the valve member opening stroke motion as a result of a preceding undesired axial length expansion of the piezoelectric stack can be prevented. This is advantageously achieved by means of a clamping device which is provided on the end of the piezoelectric stack remote from the valve member and acts directly upon the shaft of the piezoelectric stack. This clamping device can alternatively be actuated mechanically with a frictional engagement, e.g. by means of a lever or wedge system, hydraulically, e.g. with a closed volume on the end of the piezoelectric actuator, or electromagnetically with a magnet or piezoelectric actuator.

The use of a piezoelectric actuator for the clamping device on the piezoelectric stack turns out to be particularly advantageous since this functions very rapidly with a relatively low construction cost and can be triggered electrically via an electronic control device in a simple manner analogous to the piezoelectric stack actuating the valve member.

The use of the clamping device according to the invention is not limited to a particular kind of fuel injection valves, but can be advantageously used in injection valves of the inwardly and outwardly opening type.

In order to assure a sufficiently large injection cross section despite the opening stroke path of the valve member being small because of the piezoelectric actuator, particularly on the inwardly opening injection valve, the seat angle on the valve body has a range of from 60° to 120°. A particularly large opening cross section is already produced in the injection valve with a small opening stroke if the angle of the valve member tip is embodied as greater than the seat angle on the valve body; in the extreme case, the valve member end face which constitutes the sealing edge is disposed perpendicular to the valve member axis (valve member tip angle 180°) and the seat angle of the valve seat on the valve body is 90°.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
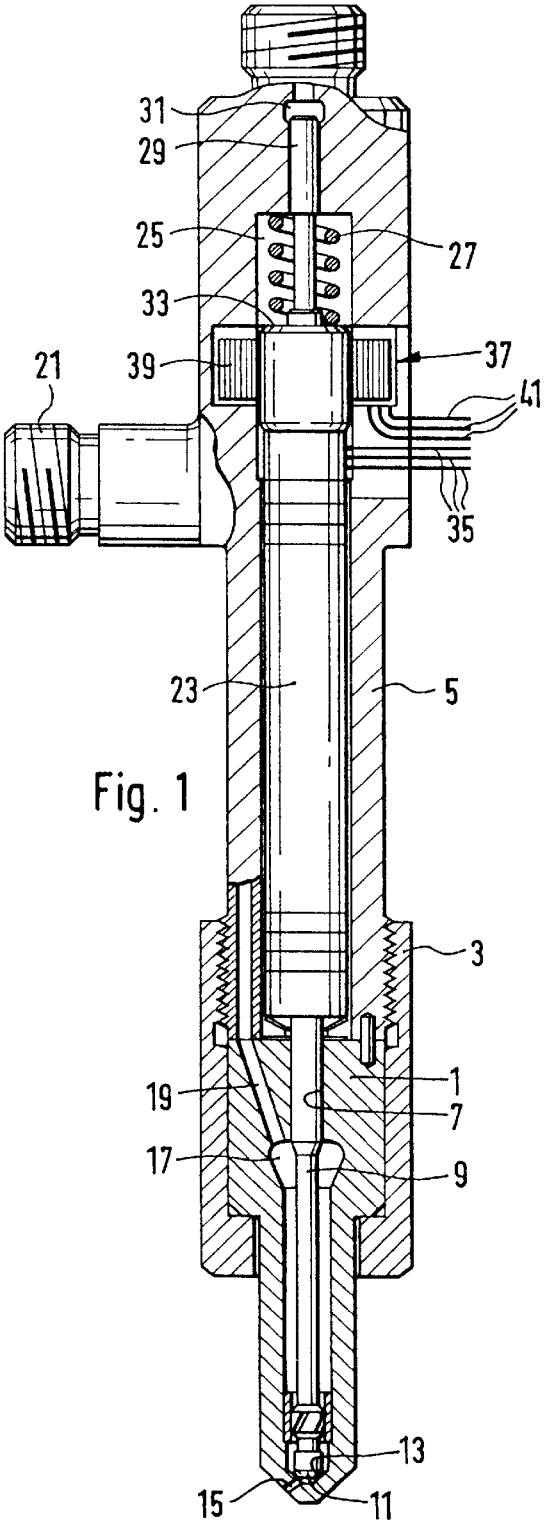
FIG. 1 shows a first exemplary embodiment in a section through an inwardly opening injection valve.

In a longitudinal section through the injection valve, FIG. 1 shows a first exemplary embodiment of the fuel injection valve for internal combustion engines, which has a valve body 1 that is axially braced against a valve retaining body 5 by means of an adjusting nut 3 and with its free end, which is reduced in cross section, protrudes into the combustion chamber of the engine to be supplied. A piston-shaped valve member 9 is axially guided in a known manner in a bore 7 of the valve body 1 and with its conical end face oriented toward the combustion chamber, constitutes a valve sealing face 11 which cooperates with a correspondingly hollow, conically embodied valve seat face 13 on the closed end of the bore 7 oriented toward the combustion chamber; downstream of the fuel to be injected, at least one injection opening 15 leading from the bore 7 connects to the bore in the wall of the valve body 1. Furthermore, the valve body 1 has an annular chamber 17 constituted by a cross sectional enlargement of the bore 7 into which a supply conduit 19 feeds fuel, which passes through the valve body 1 and the valve retaining body 5 and via a high pressure connection 21, communicates in a manner not shown in detail with an injection line leading from a high-pressure fuel pump. For actuating the valve member 9, which is pressure compensated by means of its cross sectional geometry, a piezoelectric actuator is provided in the valve retaining body 5, which actuator is embodied as a piston-shaped piezoelectric stack 23 that can be composed, for example, of a large number of disks layered axially against one another and whose axial length extends when an operating voltage is applied. On its end oriented toward the valve body 1, the piezoelectric stack 23 is connected to the valve member 9 and on its other end, a compensation piston 29 is provided, which is reduced in cross section compared to the piezoelectric stack 23, where in an axial extension, the one end rests against the end face 33 of the piezoelectric stack 23 and the free end protrudes into a compensation chamber 31. The valve retaining body 5 extends upwardly from the end of the piezoelectric stack 23 remote from the valve member defines a spring chamber 25 that is penetrated by the compensation piston 29 and in which a valve spring 27 is provided, the valve spring which acts as a compression spring, is clamped between the end face 33 of the piezoelectric stack 23 and a spring chamber wall, and acts upon the valve member 9 in the closing direction via the piezoelectric stack 23.

For its actuation, the piezoelectric stack 23 is connected to electrical supply lines 35 via which the piezoelectric stack can be acted upon by an operating voltage, wherein the control of the current supply can be carried out by an electronic control device, not shown.

For a precisely defined axial adjusting motion of the piezoelectric stack 23, and consequently a precise opening stroke motion of the valve member 9, a clamping device 37 is disposed on the upper end of the piezoelectric stack 23 remote from the valve member 9; during the injection phase, the piezoelectric stack 23, at its upper end, can be fixed in position in relation to the valve retaining body 5 by means of this clamping device. The clamping device 37 is constituted by a ring 39 disposed coaxial to the piezoelectric stack 23 or alternatively, is constituted by a number of individual annular elements of piezoceramic material disposed around the piezoelectric stack 23, whose inner diameter, when an operating voltage is applied, reduces in such a way that it rests against the circumference face of the piezoelectric stack 23 in a frictionally secured manner. The current supply is carried out via electrical supply lines 41 and, analogous to the piezoelectric stack 23, can be controlled via an electronic control device.

The first exemplary embodiment shown in FIG. 1 functions in the following manner.

When the current supply of the internal combustion engine is switched on, the piezoelectric stack 23 acting as the actuator of the valve member 9 is acted upon by a maximal operating voltage and as a result of this, axially extends to a maximal value in the direction of the spring chamber 25. The valve spring 27 assures a sealing contact of the valve member 9 against the valve seat 13. The clamping device 37 remains switched in a currentless state at this point so that the clamping ring 39 does not contact the piezoelectric stack 23. If the engine is started and an injection is to be executed in the relevant injection valve, then the clamping ring 39 is acted upon by an operating voltage and because of its diameter reduction, fixes the end of the piezoelectric stack 23 remote from the valve member in its position, by means of which the valve spring 27 is likewise rendered ineffective. To initiate the opening stroke motion of the valve member 9, the operating voltage at the piezoelectric stack 23 is now correspondingly reduced so that the piezoelectric stack 23 contracts axially and thus moves the valve member 9 in the opening direction, wherein the through flow of fuel to the injection opening 15 is opened in a known manner and the fuel is injected into the combustion chamber. When the operating voltage is completely switched off at the piezoelectric stack 23, the maximal opening stroke of the valve member 9 is achieved.

The opening stroke motion of the valve member 9 and consequently the injection course can be freely controlled by regulating the operating voltage at the piezoelectric stack. To end the injection, the piezoelectric stack 23 is once again acted upon by the maximal operating voltage and during its very rapid axial extension, moves the valve member 9 back into contact with the valve seat 13.

In order to compensate for length changes in the piezoelectric stack 23 caused by temperature and pressure, and to prevent a resultant interference with a precise opening stroke motion, the clamping device 37 is released during the injection pauses, for which purpose the piezoelectric clamping ring 39 is switched in a currentless state so that the piezoelectric stack 23 supported on the valve seat can change in length without interfering with the renewed, precise starting position. This does not have to be executed after each operating cycle, but can be carried out at certain intervals as needed.

As a result of the valve spring 27 being rendered effective when the clamping device 37 is released, the valve member 9 is pressed against the valve seat 13 with a definite force so that a sealed closing of the injection valve is assured.

Figure 2:
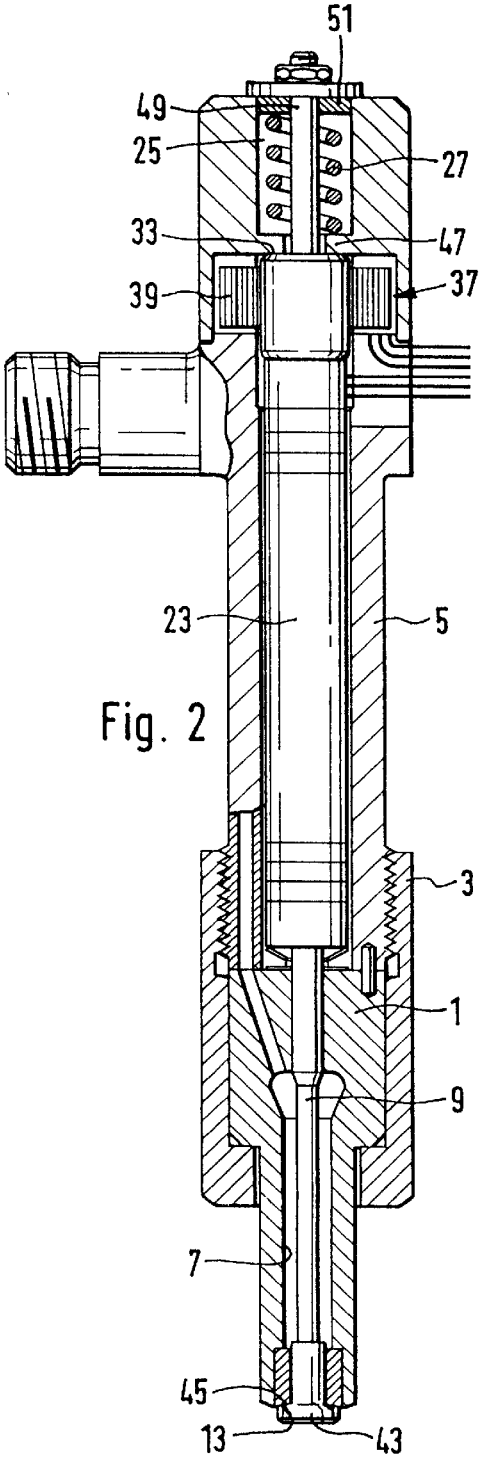
FIG. 2 shows a section through a second exemplary embodiment in which the injection valve has an outwardly opening valve member.

The second exemplary embodiment shown in FIG. 2 differs from the first exemplary embodiment only in the manner in which the injection cross section is opened in the injection valve, which is why the description is limited to the components and their functions which are embodied differently than those in FIG. 1, wherein the same reference numerals are given to the same components.

In the second exemplary embodiment, the valve member 9 has a head piece 43 on its combustion chamber end, which protrudes axially out of the bore 7 of the valve body 1 and whose annular end face 45 pointing in the direction of the valve body 1 constitutes the valve sealing face on the valve member 9. The annular end face 45 is conically embodied and cooperates with the valve seat face 13 which is disposed on the combustion chamber end face of the valve body 1 and is correspondingly embodied in the shape of a hollow cone leading out from the bore 7. The injection cross section of the injection valve is constituted in a known manner by the annular gap that can be opened between annular end face 45 and valve seat 13.

In the second exemplary embodiment, the piezoelectric stack 23, which is embodied analogously to the one in FIG. 1, is separated from the spring chamber 25 by an intermediary housing part 47 and on its end face 33 oriented toward the spring chamber 25, has a cross sectionally reduced piston extension 49 which protrudes through the spring chamber 25 and has a spring plate 51 attached to its end protruding from the spring chamber 25. The valve spring 27 is clamped between the intermediary housing part 47 and the spring plate 51 and in this way, presses the valve member 9 via the piezoelectric stack 23 so that the annular end face 45 on the head piece 43 contacts the valve seat 13.

The second exemplary embodiment shown in FIG. 2 functions in the following manner.

In the second exemplary embodiment, before the beginning of the injection phase, the piezoelectric stack 23 acting as the actuator for the valve member 9 at first remains without current and consequently at its smallest axial extension. The valve member 9 is held in sealing contact against the valve seat 13 by means of the valve spring 27, wherein the currentless and released clamping device 37 permits the piezoelectric stack 23 to axially extend longitudinally due to temperature and pressure influences. If an injection is to be carried out in the injection valve, the piezoelectric stack 23 and the clamping ring 39 are acted upon simultaneously by an operating voltage, as a result of which, analogous to the first exemplary embodiment, the clamping ring 39 fixes the end of the piezoelectric stack 23 remote from the valve member 9 in its position. When the operating voltage is applied, the piezoelectric stack 23 axially extends and in this way, moves the valve member 9 from the valve seat in the opening direction so that the opening cross section is opened in the injection valve.

When a maximal operating voltage is applied, a maximal opening stroke is achieved. The extension of the piezoelectric stack 23, and consequently the opening stroke of the valve member 9 and the course of injection can be adjusted via the operating voltage, which can be controlled by the control device. At the end of injection, the piezoelectric stack 23 is once again switched into a currentless state, contracts, and moves the valve member 9 back into contact with the valve seat 13. In order to compensate for length changes of the piezoelectric stack 23 which are caused by temperature and pressure, it is possible to release the clamping device 37 during the injection pauses by interrupting the power supply analogous to the function described in FIG. 1, wherein the valve spring 27, which is then effective, assures a sealing contact of the valve member 9 against the valve seat 13.

Figure 3:
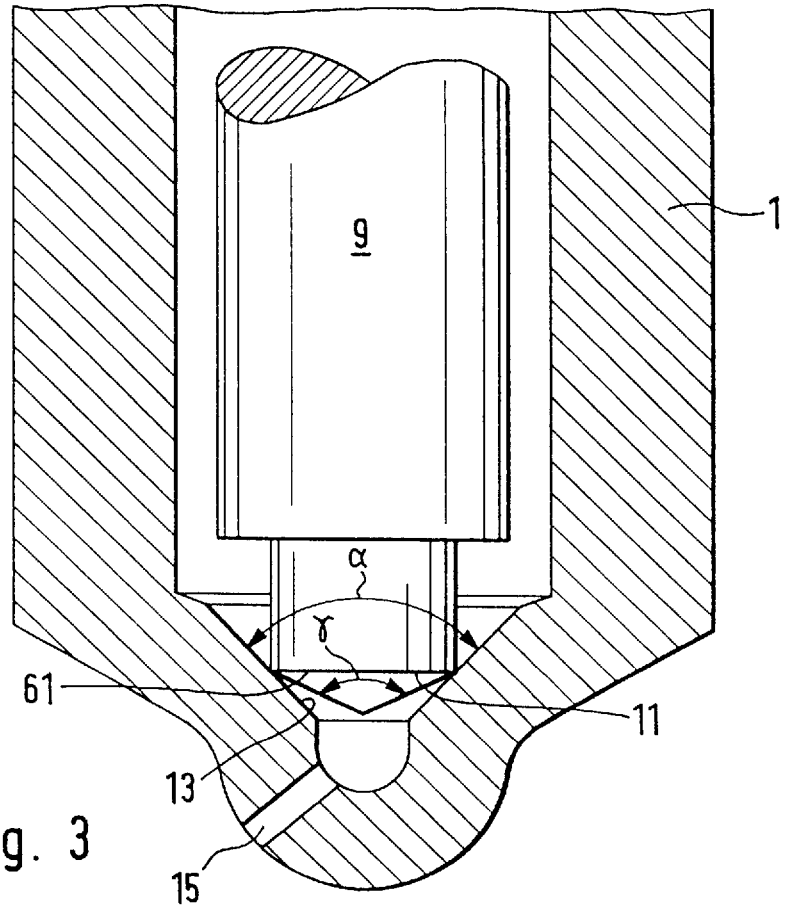
FIG. 3 shows a third exemplary embodiment in which the angle relationships of the valve sealing face and the valve seat are shown on the inwardly opening injection valve.

FIG. 3 shows an enlarged exemplary embodiment of an injection valve according to FIG. 1, with an inwardly opening valve member 9, in which the seat angle $\alpha$ of the hollow, conical valve seat 13 is 90°. With the very small opening stroke paths of the valve member 9, which are caused by the use of a piezoelectric actuator, in order to assure a sufficiently large through flow cross section between valve member 9 and valve seat face 13, the angle $\gamma$ of the valve member tip is embodied as greater than the angle $\alpha$ of the valve seat 13, wherein the angle $\gamma$ can be a maximum of 180°. An annular edge 61 formed between the shaft of the valve member 9 and the conical end face constitutes the closing cross section, wherein the diameter of the valve member shaft in the region of the valve member end face defines the seat diameter.

Consequently, with the fuel injection valve according to the invention, a pressure, temperature, and manufacture tolerance compensation can be achieved in a structurally simple manner on the piezoelectric actuator directly actuating the valve member so that a precise, reproducible opening stroke of the valve member is assured over the entire service life of the injection valve.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection valve for internal combustion engines, having a valve member (9) which is guided so that it moves axially in a valve body (1) and includes a sealing face (11) provided on a combustion chamber end face to open and close a valve seat for passage of a fuel to an injection opening (15) on the valve body (1) a piezoelectric actuator that includes a piezoelectric stack (23), said piezoelectric stack changes in length with application of a control voltage, said piezoelectric stack is coupled to an end of the valve member (9) to actuate the valve member, a valve spring (27) acts upon the valve member (9) in a closing direction, a clamping device (37) formed of a piezoelectric material that includes an operative means is provided on the piezoelectric actuator and fixes an end of the piezoelectric stack (23) remote from the valve member (9) in an axial position during the injection phase of the fuel injection valve, and permits an axial compensation for play at the piezoelectric stack (23) during an injection pause, and the clamping device (37) has a clamping ring (39) made of piezoelectric material, which encompasses a shaft of the piezoelectric stack (23) and whose inner diameter is reduced when said clamping ring is acted upon by an operating voltage.

2. The fuel injection valve according to claim 1, in which the sealing face (11) of the valve member (9) is constituted by an annular end face (45), which is oriented toward an end of the valve body (1), said annular end face is disposed on a valve member head piece (43) that protrudes from the valve body (1), and cooperates with said valve seat (13), which is disposed on the combustion chamber end face of the valve body (1) and defines a bore (7) that guides the valve member (9).

3. The fuel injection valve according to claim 1, in which the combustion chamber end face of the valve member (9) is embodied as said sealing face (11) which cooperates with a hollow, conical valve seat (13) disposed on the closed end of a bore (7) in the valve body (1), said bore contains the valve member (9); at least one injection opening (15) in the wall of the valve body (1) is connected to said valve seat, upstream in the flow direction of the fuel to be injected.

4. The fuel injection valve according to claim 3, in which the hollow, conical valve seat (13) on the valve body (1) has a seat angle $\alpha$ which is from about 60° to about 120°.

5. The fuel injection valve according to claim 4, in which the angle $\alpha$ is about 90°.

6. The fuel injection valve according to claim 3, in which the sealing face which is disposed on the valve member (9) and cooperates with the hollow, conical valve seat (13), is embodied as an annular edge (61) formed at a transition between a part of the valve member (9) shaft and a valve member tip.

7. The fuel injection valve according to claim 6, in which the angle $\gamma$ of the valve member tip is embodied as greater than the angle $\alpha$ of the valve seat face (13).

8. The fuel injection valve according to claim 7, wherein the angle $\gamma$ is about 180°.

* * * * *